United States Patent [19]

Holmes

[11] 4,157,599

[45] Jun. 12, 1979

[54] WIDE-ANGLED SELF CONTAINED HINGE FOR PANEL DOOR CABINET

[75] Inventor: Frank A. Holmes, Ballasalla, Isle of Man

[73] Assignee: Jaybee Manufacturing Corporation, Los Angeles, Calif.

[21] Appl. No.: 861,850

[22] Filed: Dec. 19, 1977

[51] Int. Cl.[2] ..... E05D 3/06; E05D 11/10

[52] U.S. Cl. ..... 16/163; 16/145; 16/164

[58] Field of Search ..... 16/163, 164, 165, 145, 16/182, 183, 50, 129, 130, 131

[56] References Cited

U.S. PATENT DOCUMENTS

| | | | |
|---|---|---|---|
| 3,523,323 | 8/1970 | Jorgensen | 16/164 |
| 3,940,828 | 3/1976 | Lautenschlaeger | 16/163 |

FOREIGN PATENT DOCUMENTS

| | | | |
|---|---|---|---|
| 2008394 | 9/1970 | Fed. Rep. of Germany | 16/164 |
| 2157147 | 5/1973 | Fed. Rep. of Germany | 16/163 |
| 2432828 | 1/1975 | Fed. Rep. of Germany | 16/50 |
| 2536744 | 6/1976 | Fed. Rep. of Germany | 16/145 |
| 2616570 | 1/1977 | Fed. Rep. of Germany | 16/164 |

*Primary Examiner*—James Kee Chi
*Attorney, Agent, or Firm*—Flam & Flam

[57] ABSTRACT

A pair of hinges have cases mounted at the very corners of a cabinet opening to define a pivot axis for a door. The cases are relatively narrow in the direction from front to back but of significant size at the region of the corner whereby the cabinet is braced by the hinge cases. Quadrilateral links are pivoted by and extend frontally of the corresponding cabinet cases to move in spaced parallel planes without interference.

The hinge leaves for the door have cases accommodated in slots at the back of the door that extend perpendicular to the pivot axis. These cases pivotally mount the other ends of the quadrilateral links for movement without interference. By virtue of the staggered arrangement, a door movement in excess of 90° is readily provided. A spring for self closing operation is accommodated in the case for one of the hinge leaves.

1 Claim, 11 Drawing Figures

WIDE-ANGLED SELF CONTAINED HINGE FOR PANEL DOOR CABINET

FIELD OF INVENTION

This invention relates to cabinet hardware, and to hinges of the type in which one of the hinge leaves is attached to the back of the cabinet door so as to be concealed.

BACKGROUND OF THE INVENTION

In a multidoor cabinet structure, a pleasing effect is achieved by positioning slab cabinet doors close to each other so that only a vary narrow gap or reveal exists. A concealed hinge is most desirable. Such door mounting arrangement is made possible by known hinges of the type that utilize quadrilateral linkages so that, as the door first opens, the hinged edge does not move laterally. Such hinges are shown and described in U.S. Pat. Nos. 3,744,086 and 3,362,042 issued to Salice et al. and Salice respectively.

In a typical quadrilateral hinge structure, one hinge leaf has a case accommodated in a shallow slot or recess near or at the edge at the back of the door. The companion hinge leaf has an elongated case attached to the side frame of the cabinet. Two such hinge structures are provided, one near, but spaced from, the top of the cabinet opening, and another near, but spaced above, the bottom of the cabinet opening. The cabinet mounted hinge leaves extend back into the cabinet a significant distance.

Such hinge structures are designed to be used in cabinets that have no face frames. A face frame, if used, reduces the size of the cabinet opening. Since the face frame is of small thickness, and since the hinge leaf extends back into the frame, part of the face frame must be cut away to allow for installation. A typical prior art quadrilateral hinge thus simply is not compatable with a face framed cabinet.

The typical quadrilateral hinge structures have certain other disadvantages. Primarily, they often are quite complicated and difficult to install. If the appearance of parallelism and equal spacing is to be achieved when slab doors are placed close to each other, the hinge structures must allow for small adjustments since slight differences in spacing become quite magnified if door edges are close together.

The primary object of the present invention is to provide a simple quadrilateral hinge structure that is easy to install, easy to adjust and that can be used just as effectively in a face framed cabinet as in a cabinet having no face frame. Additionally, an object of the present invention is to provide a quadrilateral hinge structure that braces the cabinet corners. A further object of the present invention is to provide a hinge structure that provides cabinet opening adequately far in excess of 90°.

SUMMARY OF INVENTION

In order to accomplish the foregoing objects, I provide a hinge structure, both components having cases extending generally parallel to the door opening. Instead of mounting the frame hinge leaf in cantilevel fashion at one side of the cabinet opening, the frame hinge leaf is placed at the very corner of the opening where it may be rigidly supported and where it in turn provides corner reinforcement for the cabinet. Since the frame hinge leaf extends generally parallel to the frame opening, its depth is sufficiently small so that it can be installed at the corner of a face frame with the same facility as at the corner of a cabinet having no face frame.

The two links joining the door leaf to the frame leaf are formed as plates that are thin in the direction of the pivot axis. The two links are placed in closely spaced planes so that they can move into and out of overlapping relationship in a compact manner. Mounting screws for the hinge leafs are readily accessible at the door opening and hence adjustments are easily accomplished.

BRIEF DESCRIPTION OF THE DRAWINGS

A detailed description of the invention will be made with reference to the accompanying drawings wherein like numerals designate corresponding parts in the several figures. These drawings, unless described as diagrammatic or unless otherwise indicated, are to scale.

DETAILED DESCRIPTION OF PREFERRED EMBODIMENT

The following detailed description is of the best presently contemplated modes of carrying out the invention. This description is not to be taken in a limiting sense, but is made merely for purposes of illustrating the general principles of the invention since the scope of the invention is best defined by the appended claims.

Structural and operational characteristics attributed to forms of the invention first described shall also be attributed to forms later described, unless such characteristics are obviously inapplicable or unless specific exception is made.

Figure 1:
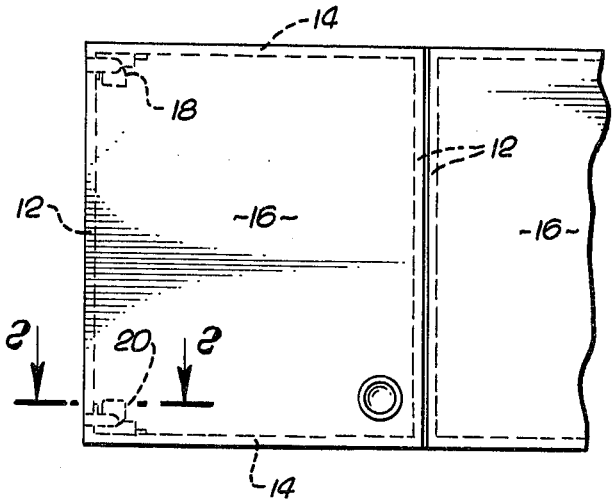
FIG. 1 is a front elevational view of a cabinet structure incorporating the present invention.
Figure 2:
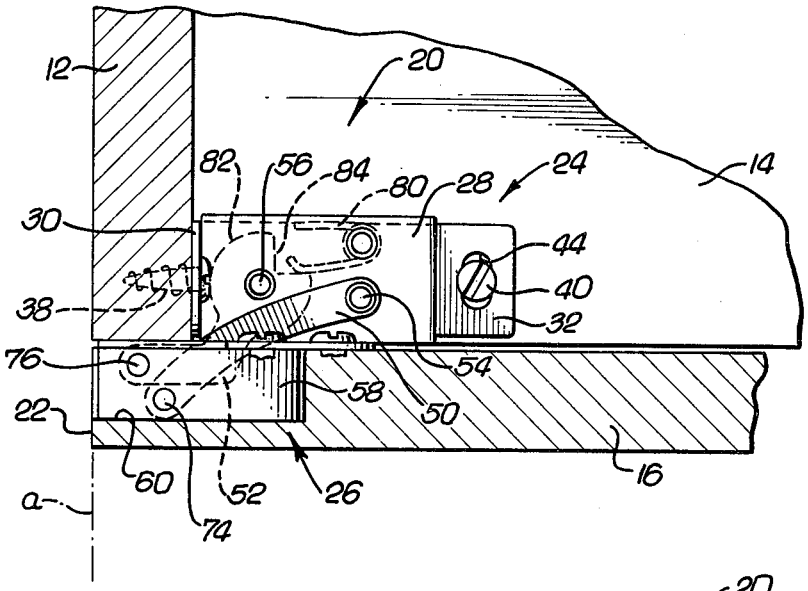
FIG. 2 is an enlarged horizontal sectional view taken along a plane corresponding to line 2—2 of FIG. 1.

The cabinet structure 10 illustrated in FIGS. 1 and 2 includes vertical frame elements 12 and horizontal frame elements 14 that define openings of the cabinet. The cabinet has no face frame; the doors 16 in the present instance are sized to overlie the edges of the openings and entirely to cover the frontally facing edges of the cabinet frame. A pair of concealed hinge structures 18 and 20 for each door 16 determines a course of movement such that the door edge 22 always lies on its side of the plane a defined by the edge 22 when the door is closed. See FIGS. 3, 4 and 5.

The hinges 18 and 20 are identical, but mirrored components. One of the hinges 18 is designed for installation at the upper corner of a door hinged at the left. For a door hinged at the right, the position of the hinges would be changed. The hinge 20 includes a frame hinge leaf 24 and a door hinge leaf 26. The frame leaf 24 provides a case formed from as a casting, or as in the present instance, a stamping. The leaf 24 has a top 28 (see also, FIGS. 6 and 7), an upwardly turned side frame attachment flange 30 at one end and at the other end, an angled outwardly turned horizontal frame attachment flange 32. Side flanges 34 and 36 (FIG. 7) provide rigidity.

The leaf 24 is located to fit exactly at the corner of the cabinet with the bottom edges of the side flanges 34 and 36 contacting the frame element 14. No template is required to locate the leaf. The frontal part of the case, namely the flange 34, is located about flush with the frontal edge of the cabinet element 14. Screws 38 and 40 cooperate with the attachment flanges 30 and 32. Apertures 42 and 44 (see FIGS. 6 and 2 respectively) allow limited front to back adjustment. Since the leaf 24 is located at the corner, the attachment screws 38 and 40 are likewise close to the corner and hence easily accessible.

The case provided by the hinge leaf 24 forms one element of a quadrilateral linkage and the companion hinge leaf 26 forms a second element. The third and fourth elements of the quadrilateral are thin links 50 and 52. The link 50 is of thin arcuate form pivoted at one end on the top 28 of the hinge leaf case, as by a pin 54. The companion link 52 is angular. One end of the link 52 is pivoted beneath the top 28 of the hinge leaf case, as by a pin 56. The lower link projects frontally through a slot 57 (FIG. 7) in the flange 34 of the case. The places of pivotal mounting of the links 50 and 52 are spaced from each other. The links 50 and 52 are thin in the direction of the pivot axis and are located in planes spaced slightly apart. Hence the links are free to move into and out of overlapping relationship.

Figure 6:
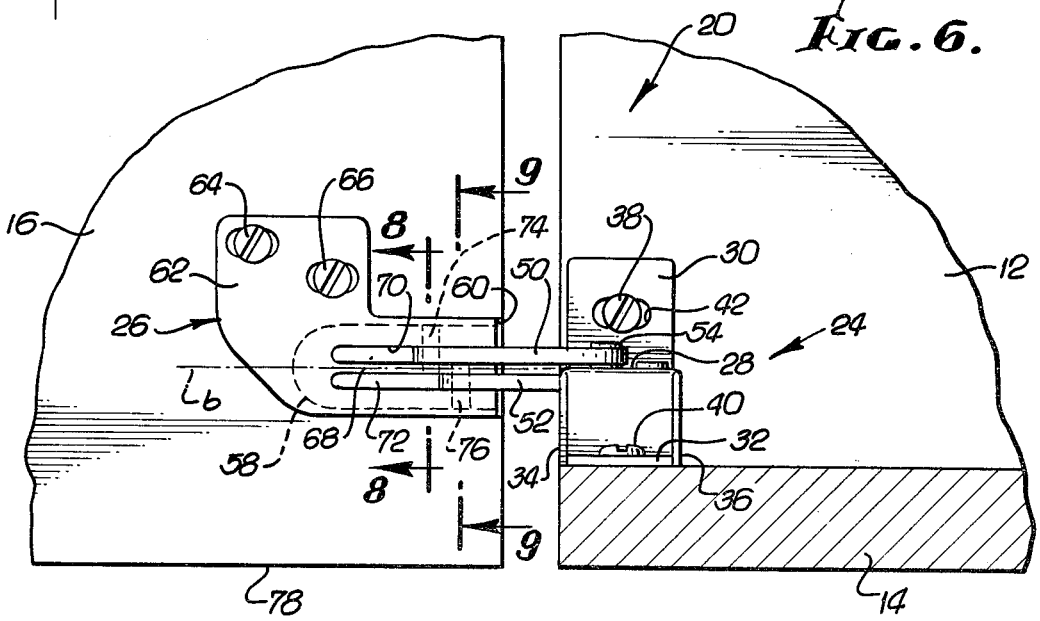
FIG. 6 is a vertical sectional view taken along a plane corresponding to line 6—6 of FIG. 4, and showing both hinge leaves with the door opened to its 90° position.
Figure 7:
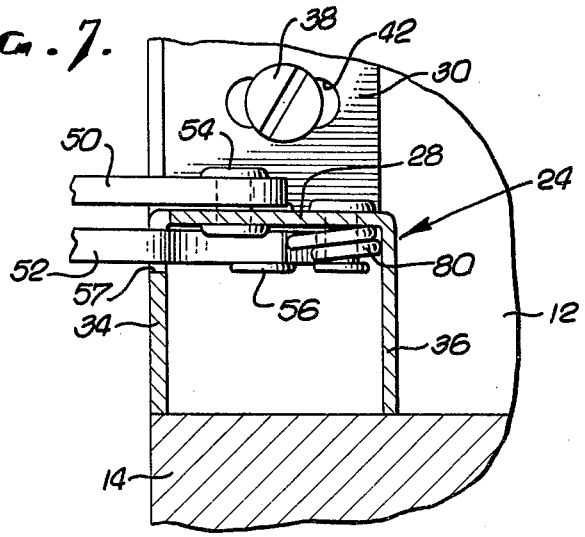
FIG. 7 is a further enlarged vertical sectional view showing the frame mounted hinge leaf.
Figure 8:
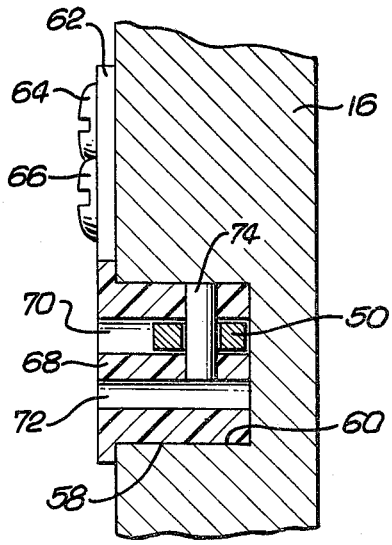
FIGS. 8 and 9 are further enlarged vertical sectional views taken along planes corresponding to lines 8—8 and 9—9 of FIG. 6 and showing the door mounted hinge leaf.
Figure 9:
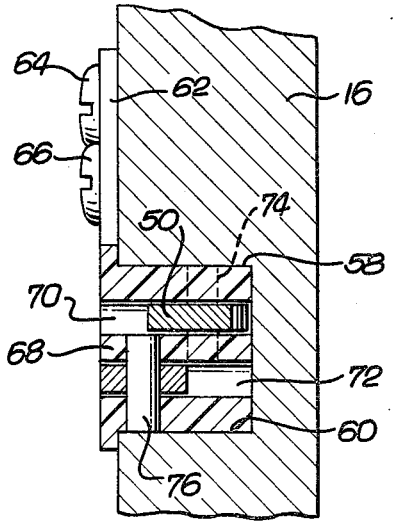

The door mounted hinge leaf 26 includes cage 58 that fits in a shallow slot 60 milled in the back of the door 16. The slot 60 extends at right angles inwardly from the edge to a distance slightly greater than the corresponding dimension of the cage 58. The cage 58 is slidable along the length of the slot 60 to a limited degree. The leaf 26 has an offset attachment flange 62 (FIG. 6). Screws 64 and 66 secure the leaf 26 in an adjusted position. The cage 58 has a central partition plate 68 (see FIGS. 8 and 9) that provides top and bottom slots 70 and 72 for respectively receiving ends of the top and bottom links 50 and 52. Pins 74 and 76 pivotally connect the links to the cage. The pin 74 is press fitted in aligned apertures in the top and partition wall of the cage to capture the link 50, the pin 74 terminating short of the bottom slot 72. The pin 76 is press fitted in aligned apertures in the bottom and partition wall of the cage to capture the link 52, the pin 76 terminating short of the top slot 70.

Figure 3:
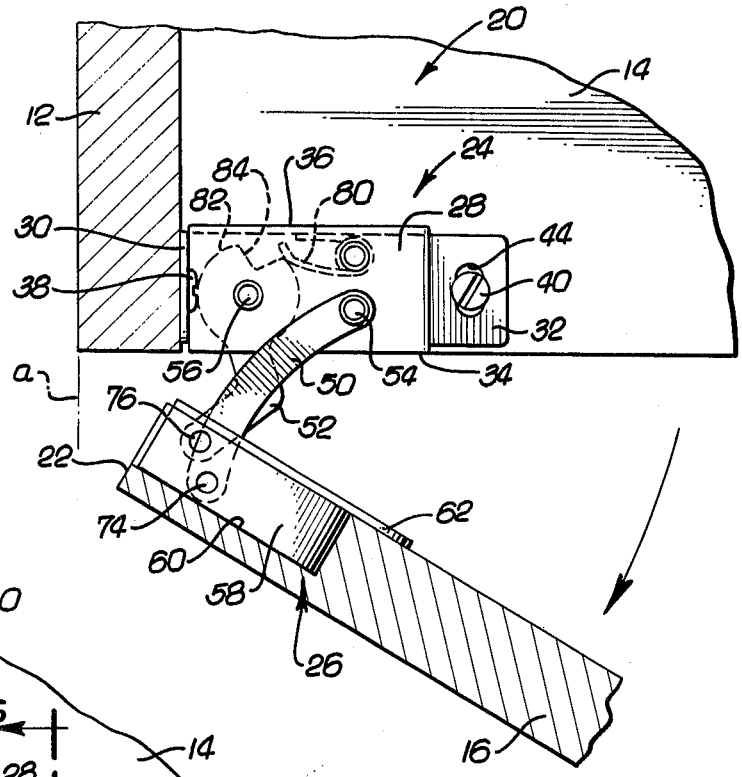
FIGS. 3, 4 and 5 are views similar to FIG. 2, but showing the door in successive positions.
Figure 4:
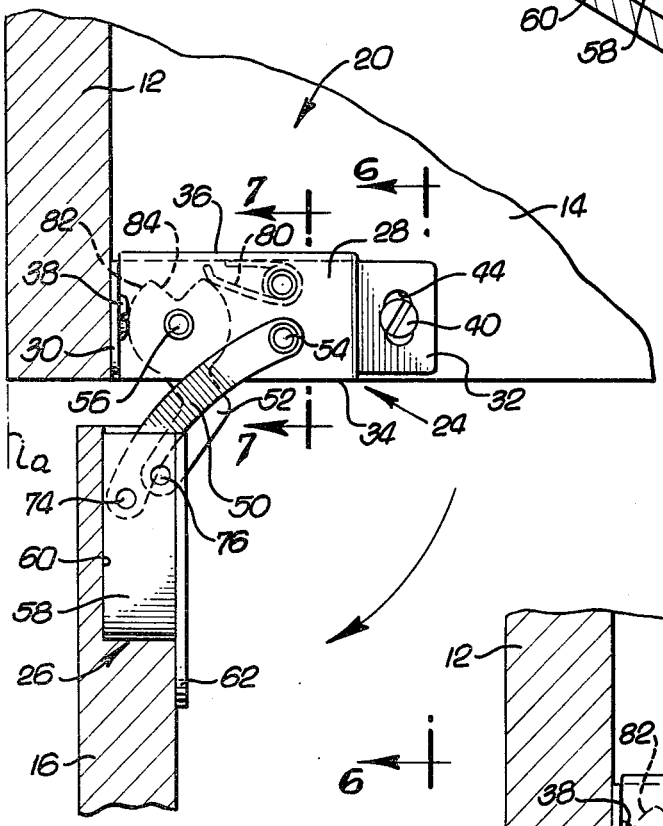
Figure 5:
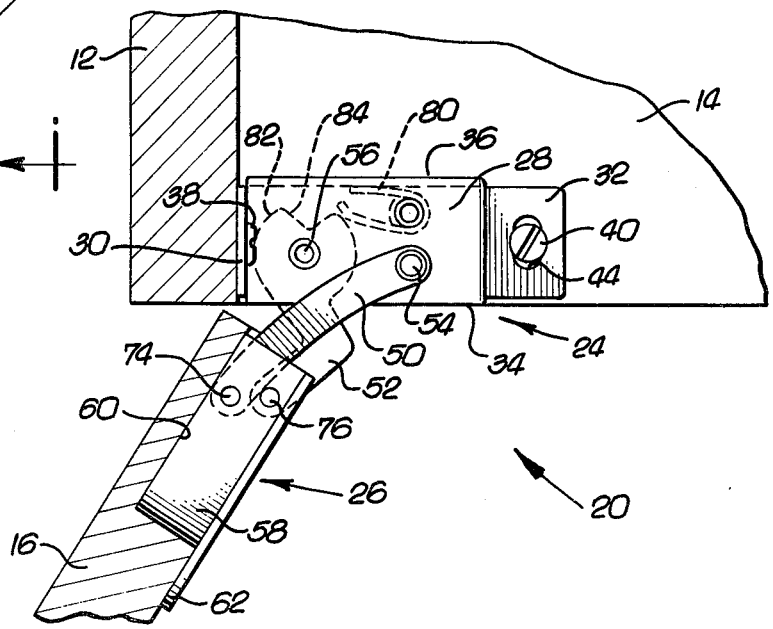

As shown in FIGS. 2, 3, 4 and 5, the links 50 and 52 form with the hinge leafs 24 and 26, a quadrilateral structure that provides the desired articulation of the door 16. As shown in FIG. 2, the pivot pins 74 and 76 are, in the closed position of the door 16, located near the door edge and in overlying relationship to the front surface of the cabinet frame element 12. The link 50 angles around the corner of the frame element 12 to the relatively near place of pivoting. Both links 50 pass through those portions of the cage slots 70 and 72 located at the inward end of the leaf 26 where the slots face the hinge leaf 24. As shown in FIGS. 3, 4 and 5, the links 50 and 52 move without interference in spaced planes.

The location of the slot 60 in the back of the door mounting at hinge leaf 26 is readily determined by a simple measurement or template. The center line b of the slot 60 (FIG. 6) falls at the level of the top mounting plate 28 of the leaf 24. The edge 78 serves as a reference for the template or measurement.

Adjustment at the screws 38 and 40 permits the door 16 to achieve a proper closing relationship with the cabinet. Adjustment at the screws 64 and 66 allows lateral adjustment of the door 16. By loosening the screws 64 and 66 either at the top or bottom of the cabinet, the door can be tilted to adjust parallelism or to compensate for non-parallelism.

A self-closing feature is easily provided by a hair spring 80 (FIG. 2). The spring 80 is pin connected beneath the top 28 of the leaf 24 for cooperation with a cam 82. The cam 82 is formed as an enlargement of the end of the link 52 and has a circular periphery interrupted by a notch 84. One leg of the spring 80 bears against the side case wall 36 and the other leg bears against the cam 82. When the door 16 is within about 30° of its closed position (FIG. 3), the spring 80 bears against one edge of the notch 84 to urge the link in a direction corresponding to door closure. In the closed position (FIG. 2), a positive closing force is yet exerted. Once the door 16 has moved beyond the position of FIG. 3, the spring 80 engages the circular periphery of the cam whereby a frictional restraint is exerted lightly to retard door movement. But no torque is exerted on the door tending to move it towards either limit. Thus, until the door approaches its closed position (FIG. 3), the door stays where it is placed.

The door 16 can be moved beyond the 90° open position of FIG. 4. The pivot pin 76 for the bottom link 50 moves on opposite sides of a line joining the pivot pins 52 and 74 as shown in FIGS. 3 and 5. The tiered arrangement of the links allows this movement.

DESCRIPTION OF ALTERNATIVE EMBODIMENT

Figure 10:
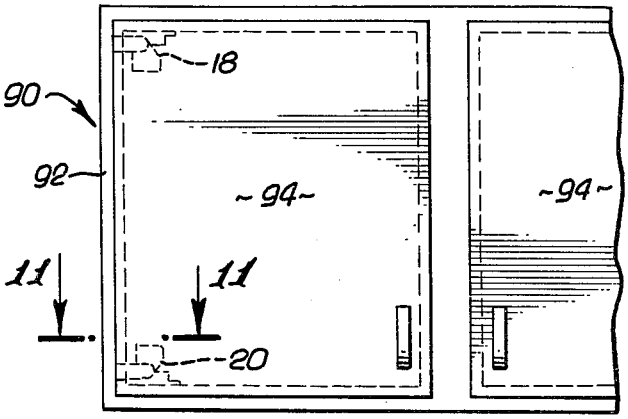
FIG. 10 is a front elevational view similar to FIG. 1, but showing an installation in which the cabinet is provided with a face frame.
Figure 11:
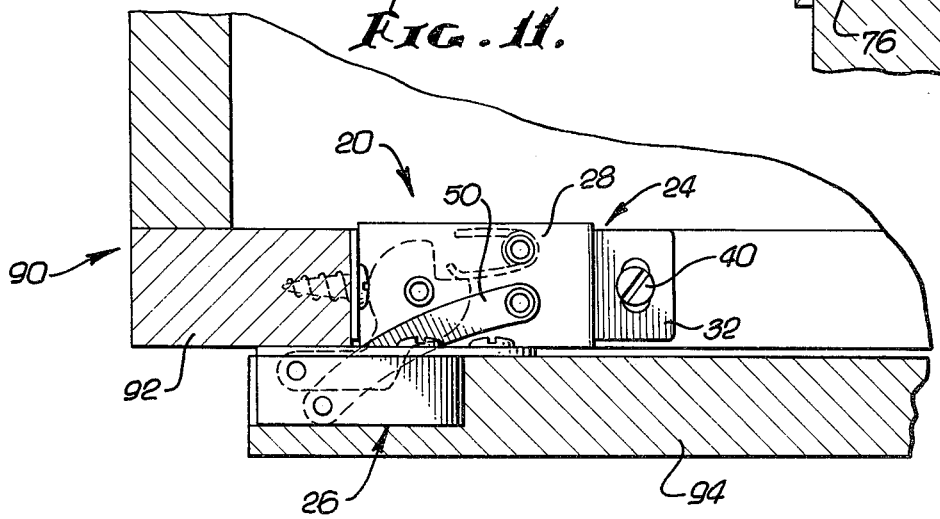
FIG. 11 is an enlarged sectional view taken along a plane corresponding to line 11—11 of FIG. 10.

In the form of the invention shown in FIGS. 10 and 11, the cabinet 90 as a face frame 92 (FIG. 11) that inwardly overlies the opening provided by the cabinet frame. A door 94 overlies the opening and is supported by hinges located at the corners of the face frame 92. The hinge leaf 24 mounted on the face frame 92 has a thickness about equal to that of the face frame 92 itself. Its mounting screws are substantially centered on the face frame 92. Not only is the hinge leaf 24 conveniently mounted, but the hinge leaf 24 provides corner bracing for the frame 92.

Intending to claim all novel, useful and unobvious features shown or described, I make the following claim:

1. For use with a cabinet door and a frame having vertical and horizontal frame elements forming a substantially rectangular opening at which the cabinet door is mounted:

(a) a pair of hinges, each hinge having a cabinet leaf and a door leaf;

(b) each cabinet hinge leaf including an elongaged case squared to nest in and fit the corresponding corner of the frame opening with the long dimension of the case extending horizontally along and in contact with the corresponding horizontal frame element;

(c) each case having attachment ears, one of the ears being located along the horizontal frame element beyond the case and the other of the ears being located along the vertical frame element beyond the case whereby fasteners at the ears cause the case to brace the frame elements of the cabinet;

(d) a pair of quadrilateral links for each hinge, said links being pivotally mounted at first ends by the corresponding case to project forwardly of the case;

(e) the door leaf of each hinge having a case attached at a slot extending along the back of the door from the pivoted door edge, each door leaf case pivotally mounting the second ends of the corresponding quadrilateral links.

* * * * *